US007614492B2

(12) United States Patent
Muse et al.

(10) Patent No.: US 7,614,492 B2
(45) Date of Patent: Nov. 10, 2009

(54) METHODS AND SYSTEMS OF HANDLING PIPE

(75) Inventors: Phillip Scott Muse, Gardendale, TX (US); Scott Warren Sellers, Midland, TX (US)

(73) Assignee: Pop's Laydown Service, L.L.C., Odessa, TX (US)

( * ) Notice: Subject to any disclaimer, the term of this patent is extended or adjusted under 35 U.S.C. 154(b) by 336 days.

(21) Appl. No.: 11/559,080

(22) Filed: Nov. 13, 2006

(65) Prior Publication Data

US 2007/0114113 A1 May 24, 2007

Related U.S. Application Data

(60) Provisional application No. 60/737,866, filed on Nov. 18, 2005.

(51) Int. Cl.
*B65G 47/34* (2006.01)

(52) U.S. Cl. ..... 198/468.6; 198/861.5; 414/22.61; 414/22.62

(58) Field of Classification Search ..... 198/468.6, 198/468.8, 861.1, 861.5; 414/22.59, 22.61, 414/22.65, 745.8, 746.1, 279
See application file for complete search history.

(56) References Cited

U.S. PATENT DOCUMENTS

| | | | | |
|---|---|---|---|---|
| 3,706,347 | A | 12/1972 | Brown | |
| 3,792,783 | A * | 2/1974 | Brown | 414/22.62 |
| 4,347,028 | A * | 8/1982 | Dugan | 414/22.61 |
| 4,684,314 | A | 8/1987 | Luth | |
| 6,079,925 | A * | 6/2000 | Morgan et al. | 414/22.57 |
| 6,899,510 | B2 | 5/2005 | Morelli et al. | |
| 7,021,880 | B2 | 4/2006 | Morelli et al. | |

OTHER PUBLICATIONS

International Search Report for International Application No. PCT/US2006/060862 filed Nov. 14, 2006 dated Dec. 3, 2007.

* cited by examiner

*Primary Examiner*—James R Bidwell
(74) *Attorney, Agent, or Firm*—Mark E. Scott; Conley Rose, P.C.

(57) ABSTRACT

Methods and systems of handling pipe. At least some of the illustrative embodiments are methods of handling pipe comprising placing a pipe on a conveyor when the conveyor is below a floor of a drilling rig (the pipe originating selectively from a first side of the conveyor or a second side of the conveyor, the second side opposite the first side), and raising the conveyor to be in operational relationship to the floor of the drilling rig.

12 Claims, 7 Drawing Sheets

METHODS AND SYSTEMS OF HANDLING PIPE

CROSS-REFERENCE TO RELATED APPLICATIONS

This application claims the benefit of provisional patent application Ser. No. 60/737,866, filed Nov. 18, 2005, titled "Pipe Handling", and which provisional application is incorporated by reference herein as if reproduced in full below.

BACKGROUND

Drill pipe handling systems are used in conjunction with hydrocarbon drilling or workover rigs (hereinafter just drilling rigs). Pipe pickup takes place when pipe at or near ground level is picked up and provided to the drilling rig. Conversely, pipe lay down takes place when pipe removed from the borehole needs to be removed from the drilling rig, such as when drilling operations are complete.

Pipe handling operations using wireline systems involve selective control of cables to which a pipe cradle is attached. For pipe pick up operations, pipe sections are picked up by the pipe cradle from a pipe rack. By controlling tension of a first cable, the elevation of the pipe cradle is changed, and by controlling tension of a second cable the horizontal position of the pipe cradle is changed. By selectively controlling the cables the pipe cradle is positioned proximate to the floor of a drilling rig, where the drilling rig's hoist jack picks up the pipe. By removing tension on the cables, and by operation of the force of gravity, the pipe cradle moves away from the drilling rig and lowers in elevation for pickup of another pipe section. For pipe lay down operations, the process is reversed, with cable tension moving the pipe cradle toward the drilling rig where a pipe is placed in the pipe cradle, and gravity forcing the pipe cradle and pipe section toward the pipe rack. Because the pipe cradle is suspended from above, pipe pickup and lay down operations are limited to one side of the pipe cradle. Moreover, when the floor of the drilling rig is close to ground level (e.g., ten feet or less), wireline system operation suffers because of the reliance on the force of gravity to return the cradle to the pipe rack elevation.

Pipe handling operations using catwalk systems involve use of a pipe lifting system that lifts pipe from the pipe rack near ground level and places the pipe on a horizontal catwalk situated at the elevation of the floor of the drill rig. Use of catwalk system is limited to drilling rigs whose floors are relatively close to the ground. For example, catwalk systems are not viable for pipe handling where the floor of the drilling rigs is relatively high (e.g., approximately 15 feet or more).

Thus, demand persists for improved pipe handling equipment and methods that are safer, more efficient and have broader application to varying drilling rig configurations.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
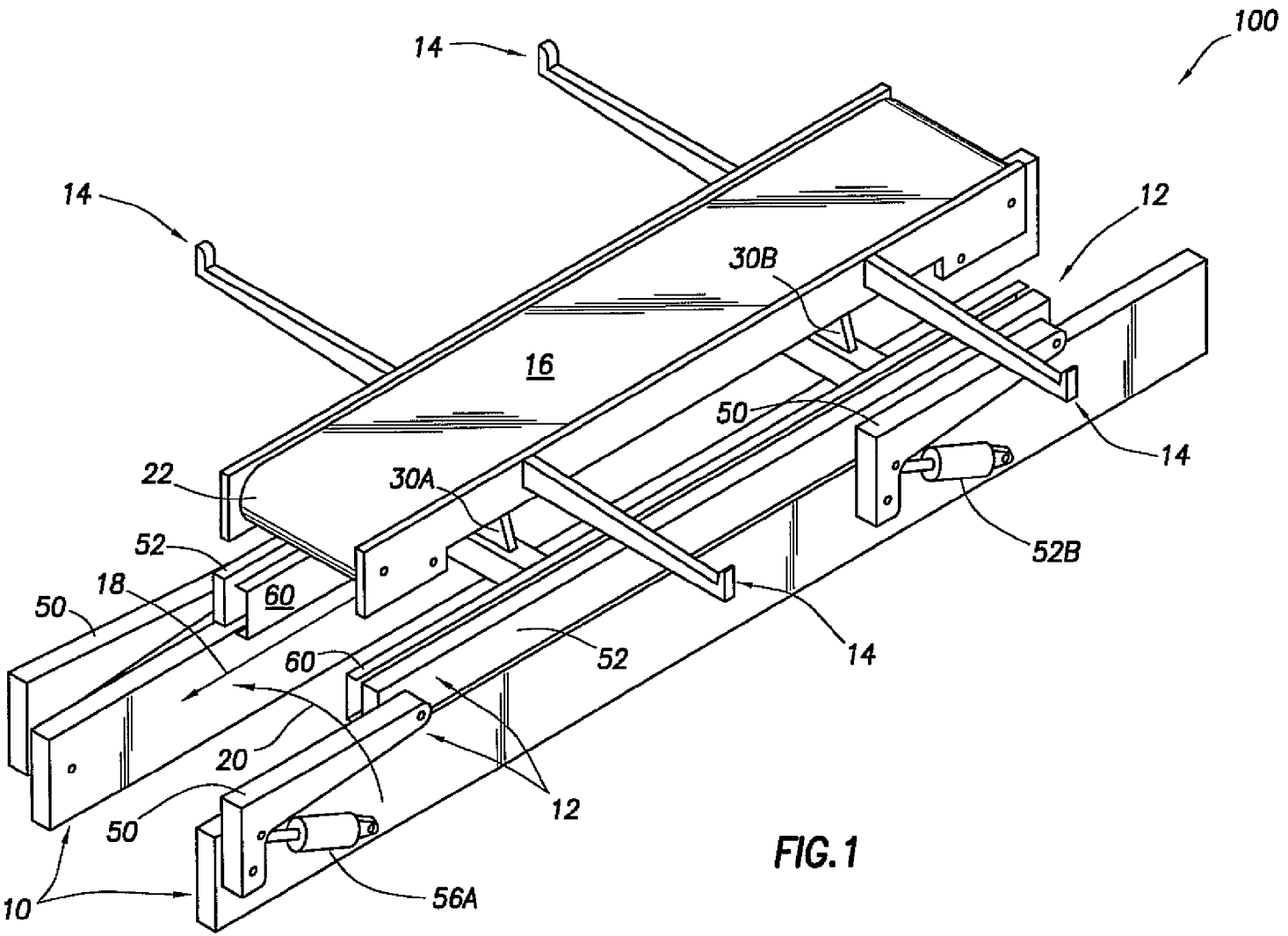
FIG. 1 shows a pipe handling system.

FIG. 1 illustrates a pipe handling system 100 in accordance with at least some embodiments of the invention. In particular, the pipe handling system 100 comprises a base unit 10 upon which a lifting system 12, pipe pickup system 14 and conveyor system 16 couple. The pipe handling system 100 of FIG. 1 is shown in the lowered configuration. For pipe pickup operations, the lowered configuration is the configuration in which the pipes are picked up from pipe racks and passed to the floor of the drilling rig. In pipe lay down operations, the lowered configuration is the configuration in which pipes are placed on the racks after being removed from the floor of the drilling rig.

In order to accomplish pipe pickup and lay down operations, various portions of the pipe handling system 100 rotate and/or translate. For example, in order to pickup and lay down pipe on pipe racks the illustrative conveyor system 16 and pipe pickup system 14 rotates about longitudinal axis 18 (discussed more with respect to FIGS. 2-4). In order to change elevation, for example to get the pipe up to or down from an elevated floor of a drilling rig, the lifting system 12 raises at least the conveyor system 16, such as by rotation in an arcing motion of arm members as illustrated by line 20 (discussed more with respect to FIGS. 5 and 6). In order to get the conveyor system 16 closer to the floor of the drilling rig, and depending on the physical placement of the pipe handling system 100 relative to the drilling rig, the conveyor system 16 horizontally translates in the direction indicated by the arrow of longitudinal axis 18 (discussed more with respect to FIG. 7). As pipe is removed from the conveyor system 16, the conveyor system 22 may operate to further horizontally translate the pipe as the draw works of the drilling rig lift one end of the pipe (discussed more with respect to FIGS. 8 and 9). Finally, as pipe is placed on the conveyor system 16 for lay down operations, the conveyor system 16 operates to horizontally translate the pipe away from the drilling rig as the draw works of the drilling rig lowers the pipe (discussed more with respect to FIGS. 8 and 9).

Figure 2:
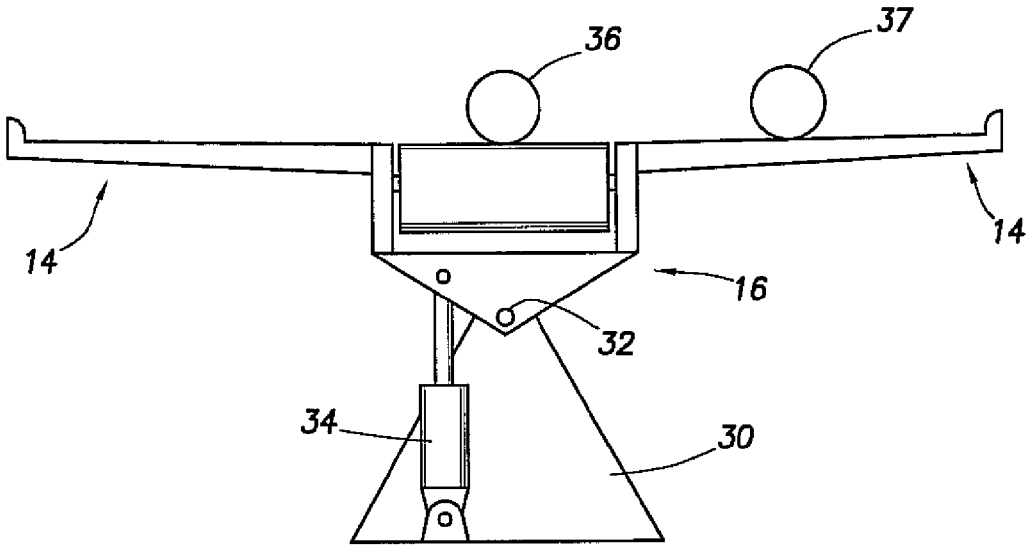
FIG. 2 shows a partial front elevational view of the pipe handling system.

FIG. 2 illustrates a partial front elevational view of the pipe handling system 100 in accordance with at least some embodiments. In particular, FIG. 2 illustrates the conveyor system 16 along with the pipe pickup system 14. The conveyor system 16 and pipe pickup system 14 couple to the base unit through a plurality of stand members 30. Only one stand member 30 is visible in FIG. 2, but two such stand members are partially visible in FIG. 1. Each stand member 30 rotationally couples to the conveyor system 16 by way of a respective hinge member 32. Hinge member 32 defines, at least in part, the longitudinal axis 18 of rotation as shown in FIG. 1. Rotation of the conveyor system 16 and the pipe pickup system 14 about the hinge member 32 is controlled, in some embodiments, by an actuator 34. While the actuator 34 is shown in a vertical orientation, in alternative embodiments the actuator 34 is horizontal in orientation. The actuator 34 may take many forms. In some embodiments, the actuator is a hydraulically operated cylinder. In alternative embodiments, the actuator is a pneumatically operated cylinder. In yet still other embodiments, any current available or after-developed system to control the rotational orientation of the conveyor system 16 and pipe pickup system 14 may be used.

The orientation of the conveyor system 16 and lift system 14 of FIG. 2 is such that the arms of pipe pickup system 14 are substantially parallel to the ground. The substantially parallel orientation is maintained when pipe is being placed on or taken from pipe handling system 100 at the floor of the drilling rig, and also while changing of elevation of conveyor system 16 by the lift system 12 (not shown in FIG. 2). FIG. 2 also shows an illustrative pipe 36 on the conveyor system 16. The upper surface of the conveyor system 16, which in some embodiments is a polymeric conveyor belt 22, can be substantially flat, or the upper surface can define a trough, tending the center the pipe 36 on the conveyor system 16. In embodiments where the upper surface is flat, a stop, fence or gate may extend along the conveyor system 16 opposite the arms that pick up the pipe, where the stop, fence or gate stops the rotational momentum of the pipe.

In some embodiments, and with respect to pipe pickup operations, once the pipe pickup system 14 is substantially parallel to the ground, pipe picked up from the pipe racks (not shown in FIG. 2) on either side of the pipe handling system 100 rolls by force of gravity to the conveyor system 16, as illustrated by pipe 37. The rolling for pipe pickup may be caused by slight inclination of the illustrative arms of the pipe pickup system 14, by over rotating the pipe pickup system 14, or both. With respect to pipe lay down operations, once the pipe is on the conveyor system 16, the pipe may roll down the illustrative arms of the pipe pickup system 14 by force of gravity to be placed on the pipe rack. The rolling for pipe lay down may be caused by slight inclination of the illustrative arms of the pipe pickup system 14, by rotation of the conveyor system 16 and/or pipe pickup system 14 in the direction of the desired rack, or both. While FIG. 3 shows two illustrative pipes, in some embodiments only one pipe resides on the conveyor system 16 and/or pipe pickup system 14 at any one time, although multiple pipe operation is contemplated in alternative embodiments.

Figure 3:
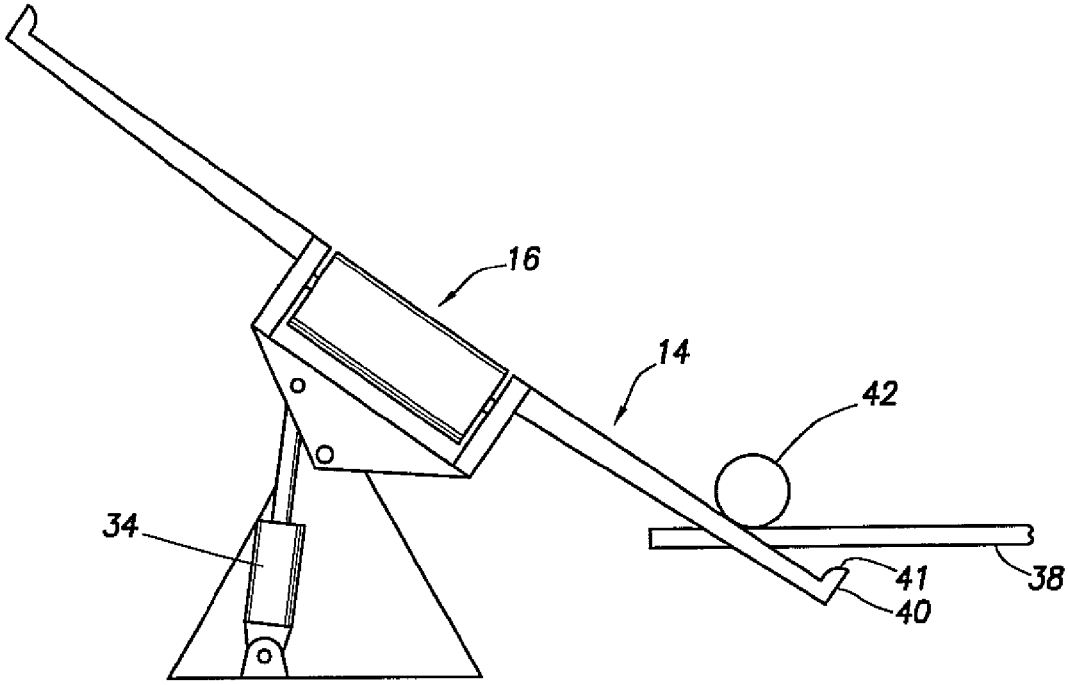
FIG. 3 shows a partial front elevational view of the pipe handling system in a first rotated orientation.

FIG. 3 shows, in accordance with some embodiments, the conveyor system 16 and pipe pickup system 14 rotated to be in operational relationship with a first pipe rack 38. In particular, by actuation (in this illustrative case extension) of the actuator 34, the conveyor system 16 and pipe pickup system 16 rotate about the hinge member 32. The rotation causes the distal end 40 of the illustrative arms of the pipe pickup system 14 to drop below the upper-most elevation of the pipe rack 38. In pipe pickup operation, a pipe is rolled to the position illustrated by pipe 42, and the conveyor system 16 and pipe pickup system 14 are rotated back to a substantially horizontal orientation. During a portion of the rotation, the pipe rests against stop 41. By operation of inclination of the illustrative arms of the pipe pickup system 14, by slight over-rotation in a direction opposite the first pipe rack 38, or both, the pipe is rolled by force of gravity to the conveyor system 16.

For pipe lay down operations, a pipe rolls off the conveyor system 16 and down the illustrative arms of the pipe pickup system 14 to contact the rack. In order that the pipe is not again picked up, the pipe is rolled away from the pipe pickup system 14 by an operator, the rack may slope away from the pipe handling system 100 such that the pipe rolls beyond the reach of the pipe pickup system 14 by force of gravity, momentum of the pipe rolling down the illustrative arms may carry the pipe beyond the reach of the pipe pickup system 100, or a combination of these. In cases where the elevational change between the top of the conveyor system 16 and top of the pipe rack is large, the speed of the pipe may become excessive. In these situations the pipe's speed may be reduced by covering the upper surfaces, in whole or in part, of the illustrative arms of the pipe pickup system 14 with a material that creates a higher resistance to rolling than bare metal alone, such as rope or elastomeric materials.

Figure 4:
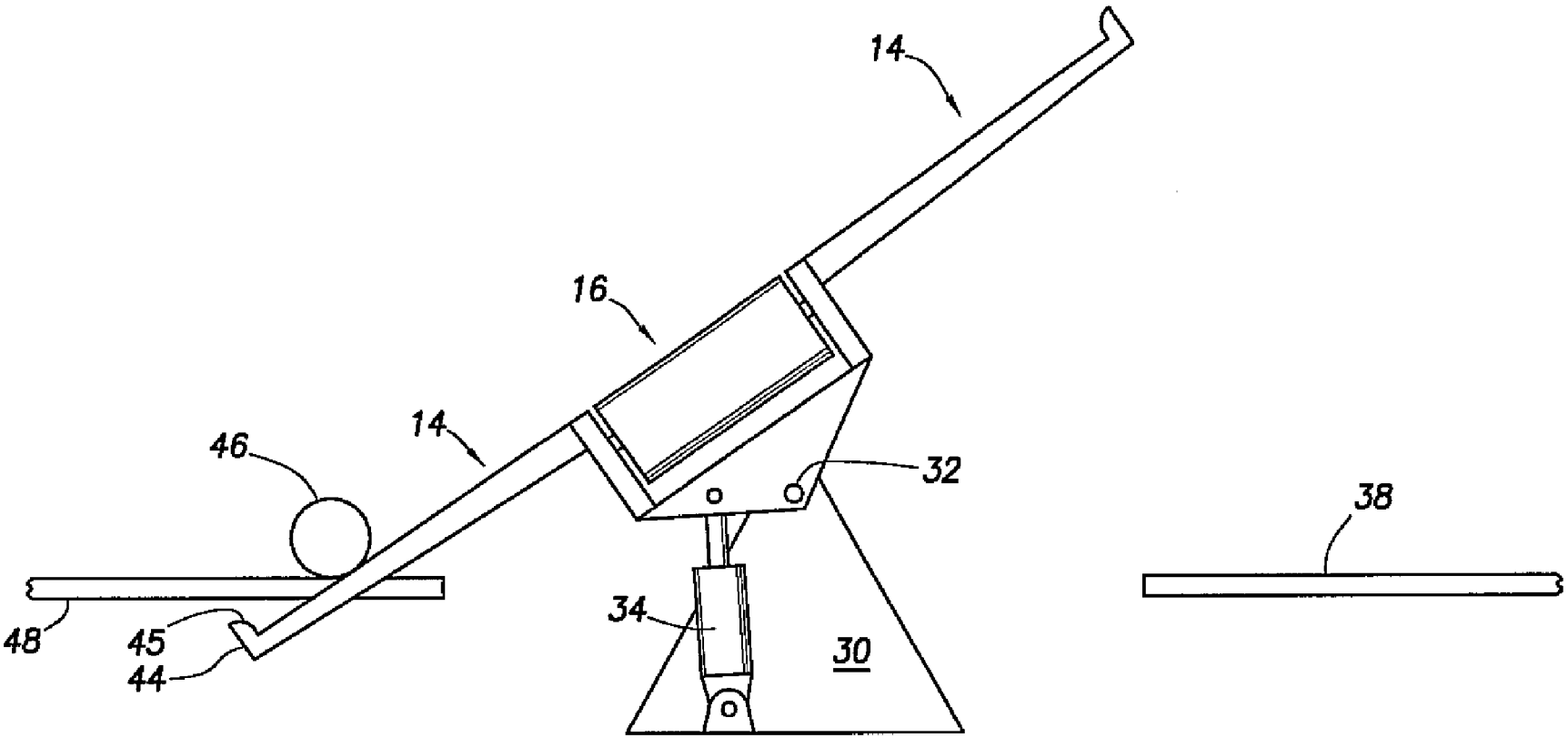
FIG. 4 shows a partial front elevational view of the pipe handling system in a second rotated orientation.

FIG. 4 shows the conveyor system 16 and pipe pickup system 14 rotated to be in operational relationship with a second pipe rack 48. In particular, by actuation (in this illustrative case retraction) of the actuator 34, the conveyor system 16 and pipe pickup system 14 rotate about the hinge member 32. The rotation causes the distal end 44 of the illustrative arms of the pipe pickup system 14 to drop below the upper-most elevation of the pipe rack 48. In pipe pickup operation, a pipe is rolled to the position illustrated by pipe 46, and the conveyor system 16 and pipe pickup system 14 are rotated back to a substantially horizontal orientation. During a portion of the rotation, the pipe rests against stop 45. By operation of inclination of the illustrative arms of the pipe pickup system 14, by slight over-rotation in a direction opposite the second pipe rack 48, or both, the pipe is rolled by force of gravity to the conveyor system 16.

For pipe lay down operations, a pipe rolls off the conveyor system 16 and down the illustrative arms of the pipe pickup system 14 to contact the rack 48. In order that the pipe is not again picked up, the pipe is rolled away from the pipe pickup system 14 by an operator, the rack may slope away from the pipe handling system 100 such the pipe rolls beyond the reach of the pipe pickup system 14 by force of gravity, momentum of the pipe roiling down the illustrative arms may carry the pipe beyond the reach of the pipe pickup system 100, or a combination of these. Thus, the pipe handling system 100 has the ability to pickup pipe from either side of the system 100, and likewise has the ability to lay down pipe on either side of the system 100.

Figure 5:
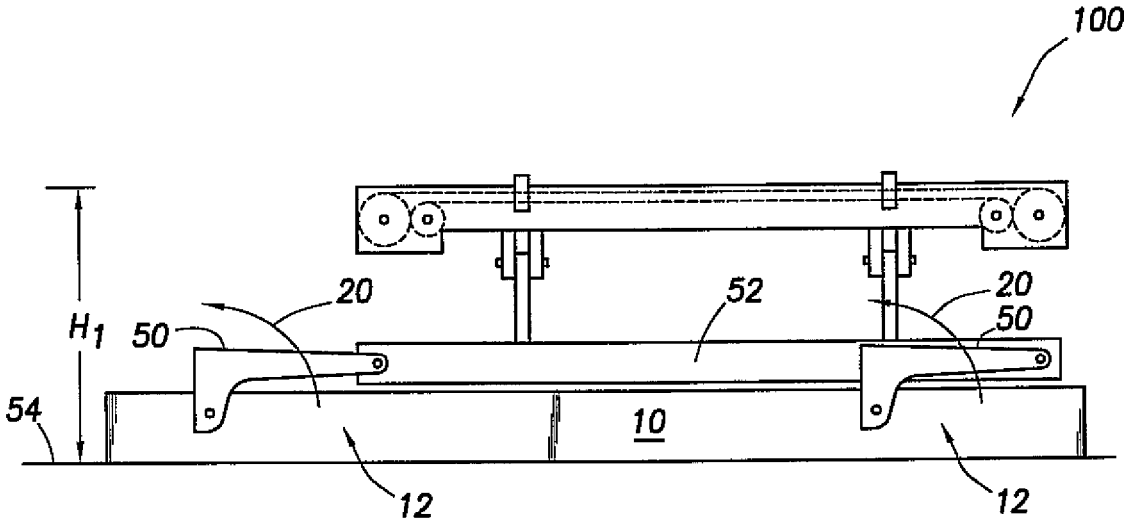
FIG. 5 shows a partial side elevational view of the pipe handling system in a lowered configuration.

Attention now turns to changing the elevation of the top of the conveyor system 16 in relation to the floor of a drilling rig. FIG. 5 shows a partial elevational side view of the pipe handling system 100 in a lowered or retracted configuration. In particular, the arms 50 of the lifting system 12 are rotated such that structural support members 52 (only one visible in FIG. 5, but both are visible in FIG. 1) rest on or near the base unit 10. In the retracted configuration, the distance from the ground 54 level to the top of the conveyor system 16 is defined to be $H_1$. In some situations, the height $H_1$ may be sufficient to provide drill pipe to the floor of the drilling rig, and to remove pipe from the floor of the drilling rigs. Stated otherwise, no elevational changed may be needed when the height of the floor of the drilling rig is approximately $H_1$. In such situations, the pipe handling system may merely rotate about longitudinal axis 18 (FIG. 1) to pickup and lay down pipe for an associated drilling rig.

However, in other situations the floor of the drilling rig may be higher in elevation than $H_1$. In order to address the possibility of the floor of the drilling rig being higher than the lowered position of the pipe handling system 100, the lift system 12 (comprising arms 50 as well as actuation devices, such as actuation devices 56 shown in FIG. 1) lifts the structural members 52, and thus the conveyor system 16. In some embodiments, the lifting is caused by rotation of the arms 50 in an arcing motion, as illustrated by line 20 in FIG. 1 and corresponding line 20 in FIG. 5.

Figure 6:
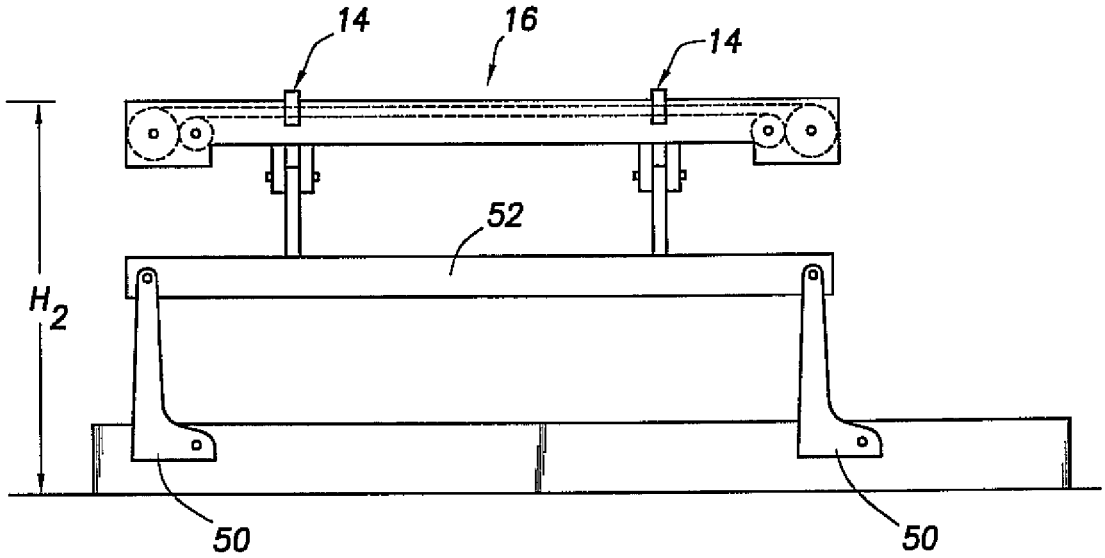
FIG. 6 shows a partial side elevational view of the pipe handling system in an raised configuration.

FIG. 6 shows the pipe handling system 100 in the elevated orientation. In particular, arms 50 are rotated (such as by extension of actuator devices 56 of FIG. 1), which causes both an elevational change and horizontal translation of the conveyor system 16. The elevated orientation of the pipe handling system 100 thus provides a height $H_2$, where $H_2>H_1$. FIG. 6 illustrates height $H_2$ at its maximum; however, in operation of the pipe handling system 100 the maximum height $H_2$ need not be achieved for every lifting of the conveyor system 16. For example, if the elevation of the floor of the drilling rig is between $H_1$ and $H_2$, the arms 50 are only partially rotated to place the conveyor system 16 in operational relationship with the floor of the drilling rig. Before proceeding, it should be understood that lifting the conveyor system 16 by rotating arms 50 is merely illustrative. Any currently available or after-developed system to selectively raise and lower the conveyor system 16 may be equivalently used. For example, the lifting system 12 may involve the use of a "scissor lift" mechanism, where elevational change is achieved without corresponding horizontal translation. The horizontal translation achieved by the rotation of the arms 50 is advantageous in placing the conveyor system 16 in operational relationship to the floor of the drilling rig.

In embodiments where there is not a corresponding horizontal translation during the elevational change of the conveyor system 16, or where the horizontal translation is insufficient to place the conveyor system 16 in operational relationship to the floor of the drilling rig, the pipe handling system 100 is also configured to separately and selectively horizontally translate the conveyor system 16 toward the floor of the drilling rig. Returning briefly to FIG. 1, conveyor system 16 and pipe pickup arms 14 slidingly couple to the structural support member 52 by way of channel members 60. In particular, the channel members 60 couple to the structural support members 52 in such as way that horizontal translation as between them is possible, but substantially no other movement is possible. The translational coupling can be way of a set of rollers, a linear bearing, or another suitable mechanism.

Figure 7:
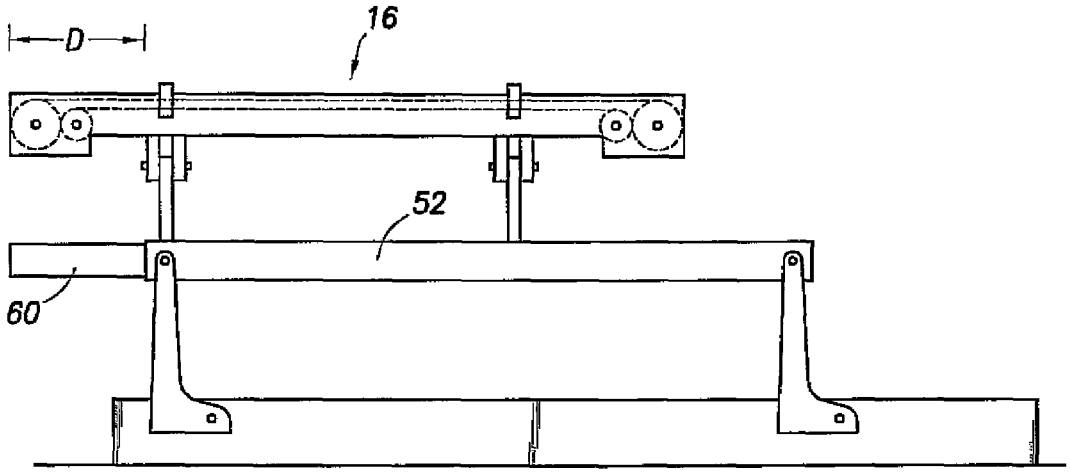
FIG. 7 shows a partial side elevational view of the pipe handling system with the conveyor system extended.

FIG. 7 shows the pipe handling system 100 in an elevated state with the conveyor system 16 horizontally translated along channel members 60 (as opposed to the elevated but retracted state shown in FIG. 6). In particular, the horizontal translation provided by the sliding engagement of the channel members 60 with respect to the structural support member 52 provides a horizontal displacement D, which in some cases assists in placing the conveyor system 16 in operational relationship to the floor of a drilling rig. Horizontal translation of the conveyor system 16 may use any suitable actuation system. For example, in some embodiments one of the channel members is fitted with a rack of rack-and-pinion system, while the pinion portion is coupled to the shaft of a motor (electric, hydraulic or pneumatic) coupled to the structural support member 52. By selective operation of the motor, the conveyor system 16 may be horizontally translated to and from the extended position shown. In alternative embodiments, a hydraulic or pneumatic cylinder may couple on one side to the one of the channel members 60 (or any other portion of the pipe handling system that horizontally translates) and on a second side to the structural support member 52, and the selective translation may be accomplished by extension and retraction of the shaft of the cylinder.

Figure 8:
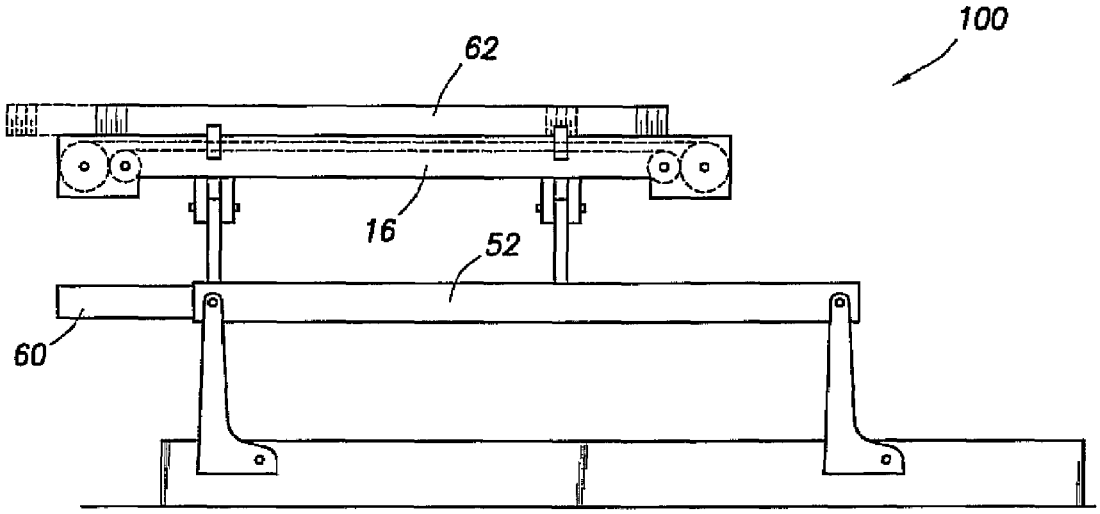
FIG. 8 shows a partial side elevational view of the pipe handling system illustrating pipe positioning based on operation of the conveyor system.

In addition to the possible horizontal translation of the conveyor system 16 caused by rotation of arms 50 in some embodiments, as well as the horizontal translation affected by the channel member 60 being in sliding relationship with the structural support members 52, it may be desirable in some situations to horizontally translate a pipe on the conveyor system 16 by operation of the conveyor system itself. FIG. 8 shows the pipe handling system 100 in its elevation configuration, and also with the conveyor system 16 in its horizontally translated configuration. FIG. 8 also shows a pipe 62 resting on the conveyor system 16. While having the pipe 62 approximately centered along the long dimension of the conveyor system 16 is desirable when the pipe handling system 100 is changing elevation and/or horizontal position, in order to raise the pipe by draw works of the drilling rig (for pickup operations) or to place pipe on the conveyor system 16 (for lay down operations), access to one end of the pipe is desirable. In order to achieve such access, and in accordance with at least some embodiments, the conveyor system 16 is configured to selectively horizontally translate the pipe 62 toward and away from the floor of the drilling rig. FIG. 8 shows, in dashed lines, a horizontally translated pipe, where the translation is caused by operation of the conveyor system 16. The dashed line version of the pipe is thus more accessible for connecting the pipe to draw works of the drilling rig, either for raising the pipe 62 off the conveyor system 16 (pickup operations), or for placing the pipe on the conveyor system (lay down operation).

Figure 9:
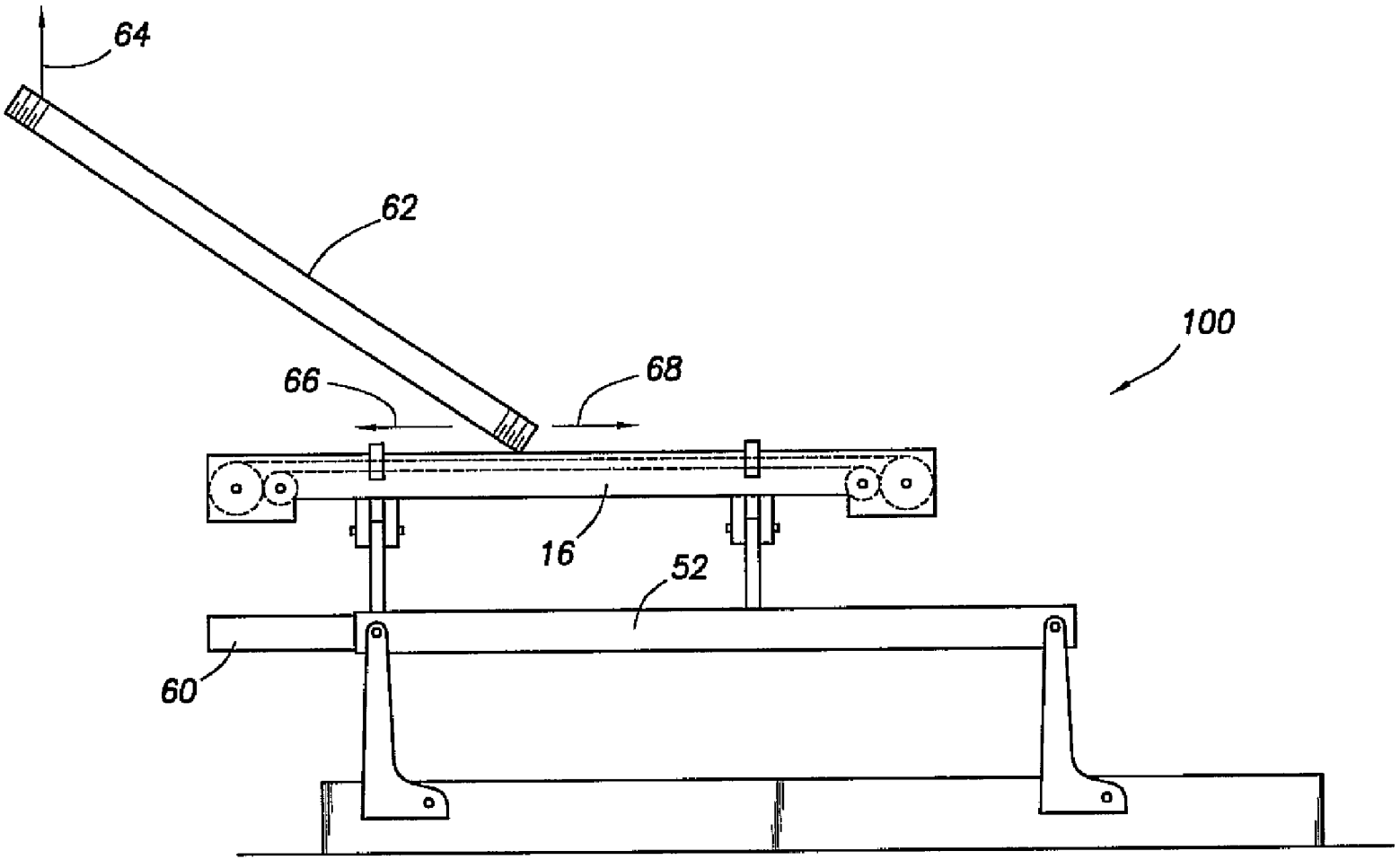
FIG. 9 shows a partial side elevational view of the pipe handling system illustrating operating of the conveyor system as the pipe is being pickup up from or placed on the conveyor system.

Not only is conveyor system 16 operable to horizontally translate pipe to and from the position shown in FIG. 8, but the conveyor system 16 also assists during periods of time when draw works of the drilling rig are in the process of raising and lowering the pipe. FIG. 9 shows the pipe handling system 100 with pipe 62 being raised off or lowered onto the conveyor system 16. Considering first raising the pipe off the conveyor system 16 (pickup operations). As the draw works raise the pipe 62 in the direction indicated by arrow 64, the conveyor system horizontally translates the end of the pipe still on the conveyor system toward the drilling rig, as indicated by arrow 66 (termed "chasing the pipe"). Assisting raising the pipe in such a manner presents several advantages. First, the end of the pipe 62 is not dragged by the upward motion, thus lessening the likelihood of damaging threads. Second, controlling the horizontal motion helps keep the block of the draw works centered in the drilling rig, lessening the likelihood of hitting the derrick portion of the drilling rig (or any member of a crew standing on the derrick) with the block of the draw works.

Now considering lowering the pipe onto the conveyor system 16 (lay down operations). During lay down operations, pipe that was used by the drilling rig is held on one end by the draw works, and slowly lowered. Arrow 64 (discussed with respect to pickup operations) in FIG. 9 is equally applicable to lay down operations, except that the force applied by the draw works is lowered such that the pipe 62 tends to drop. The second end of the pipe 62 is placed on the conveyor system 16, and the conveyor system 16 operates to move the pipe in the direction indicated by arrow 68. Assisting in lowering the pipe in such a manner presents several advantages. First, the end of the pipe 62 is not forced to move against a motionless surface by the downward motion, thus lessening the likelihood of damaging threads. Second, controlling the horizontal motion helps keep the block of the draw works centered in the drilling rig, lessening the likely hood of hitting the derrick portion of the drilling rig with the block of the draw works.

Figure 10:
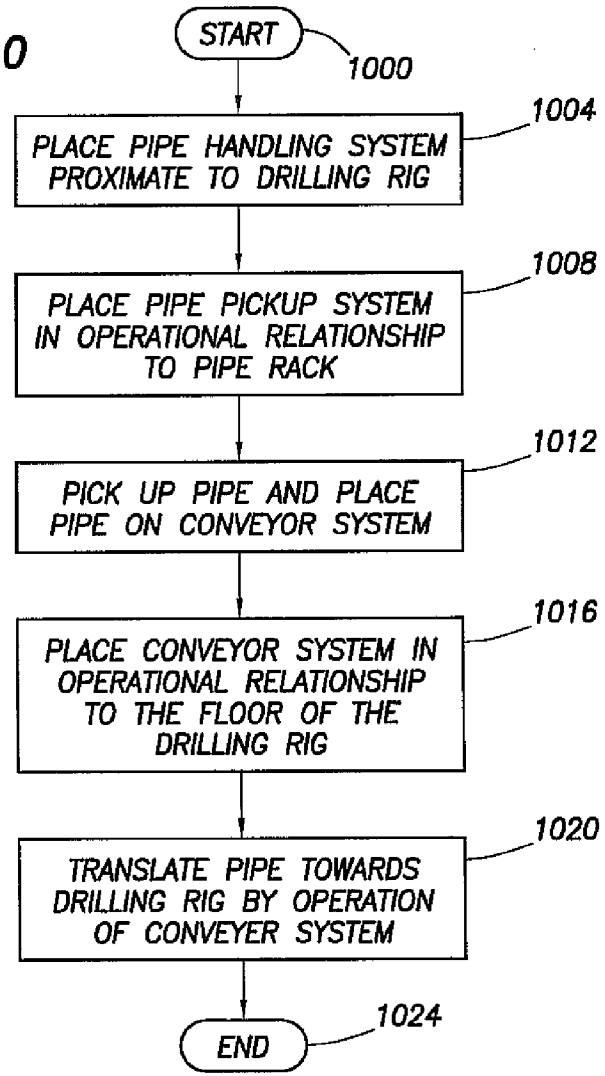
FIG. 10 illustrates a method in accordance with some embodiments.

FIG. 10 illustrates a pipe pickup method in accordance with at least some embodiments. The method starts (block 1000) and proceeds to placing the pipe handling system 100 proximate to the drilling rig (block 1004). The placing of the pipe handling system 100 may take many forms. In some embodiments the pipe handling system is trailer mounted, and placing the system involves positioning the trailer. In other embodiments, the pipe handling system 100 is transported via trailer, but the placing involves removing the system 100 from the trailer and setting the system directly on the ground. In other embodiments, because of the height of the floor of the drilling rig, the pipe handling system may be placed above ground level, such as on a cat walk structure.

The next step in the illustrative method is rotating the pipe pickup system 14 such that the pipe pickup system 14 is in operational relationship to pipe on a pipe rack (block 1008). The pipe rack may be on a first side of the pipe handling system 100, or on a second side opposite the first side. Pipe is then picked up by the pipe pickup system 14 (e.g., by rotation of the pipe pickup system 14), and the pipe allowed to roll to be on the conveyor system 16 (block 1012) (discussed with respect to FIGS. 2-4). Stopping the pipe on the conveyor system 16 may be caused by a trough configuration of the conveyor system 16, or in alternative embodiments a fence running substantially the length of the conveyor system 16 may act to stop the rotational movement of the pipe. In most cases, placing the pipe on the conveyor system 16 takes place while the conveyor system is below the floor of the drilling rig.

Still referring to FIG. 10, the conveyor system 16 is then placed in operational relationship to the floor of the drilling rig (block 1016). In some situations, placing the conveyor system 16 in operational relationship to the floor of the drilling rig involves raising the convey system 16, such as by operation of lifting system 12 (and as discussed with respect to FIGS. 5 and 6). In other situations, placing the conveyor system 16 in operational relationship to the floor of the drilling rig involves horizontal translation of the conveyor system 16. In some embodiments, the horizontal translation is integral with raising the conveyor system 16 by operation of the lifting system 12. In other embodiments, the horizontal translation is by horizontally translating the conveyor system 16 by way of channel members 60. In yet still other embodiments, the horizontal translation is a combination of both horizontal translation provided by the lifting system 12 and horizontal translation by way of the channel members 60.

Regardless of the extent, if any, of horizontal translation of the conveyor system 16 itself, the next step of the illustrative method is horizontal translation of the pipe by operation of the conveyor system (block 1020), and the method ends (block 1024). In some embodiments the conveyor system 16 comprises a conveyor belt 22 (FIG. 1), and horizontal translation of the pipe involves moving belt 22. In alternative embodiments the conveyor system 16 comprises a carriage mechanism that pushes the pipe based on movement of the carriage mechanism. FIG. 8 shows an example of horizontally translating the pipe by operation of the conveyor system 16. Thereafter, the conveyor system 16 continues to horizontally translate the pipe as draw works of the drilling rig raise the pipe off the conveyor system 16 (FIG. 9).

Figure 11:
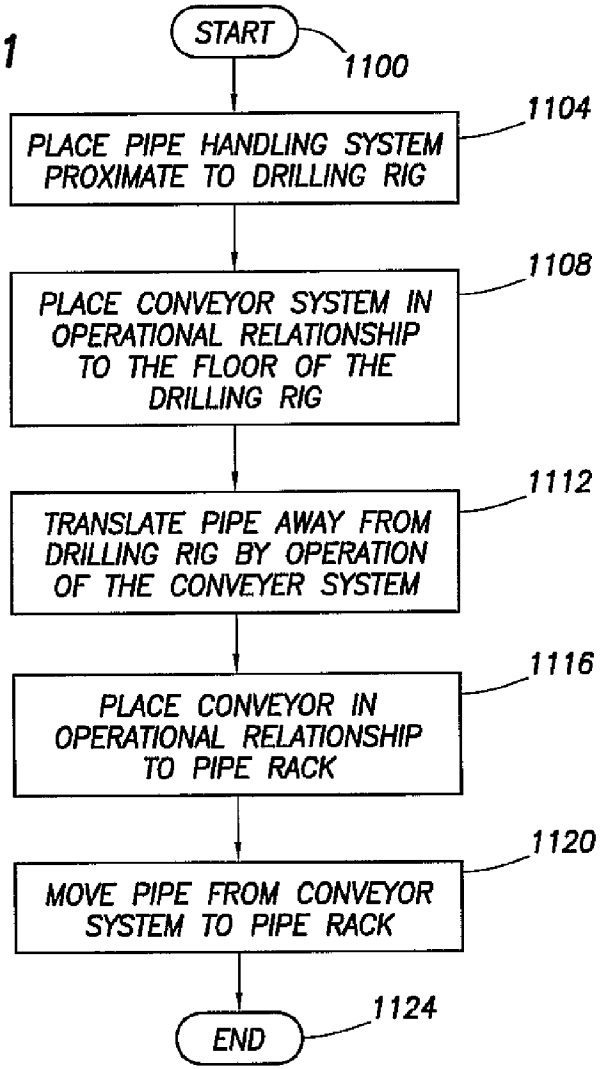
FIG. 11 illustrates a method in accordance with some embodiments.

FIG. 11 illustrates a pipe lay down method in accordance with at least some embodiments. The method starts (block 1100) and proceeds to placing the pipe handling system 100 proximate to the drilling rig (block 1104). The pipe handling system 100 may have already been placed for pipe pickup operations, and thus placing the system may be omitted. Next, the conveyor system 100 of the pipe handling system 100 is placed in operational relationship to the floor of the drilling rig (block 1108), such as by elevational changes and/or horizontal translation of the conveyor system. Thereafter, the conveyor system 16 itself operates to horizontally translate an end of the pipe resting on the conveyor system 16 as draw works of the drilling rig lowers the pipe (block 1112). Once the pipe is laying flat on the conveyor system 16 and the pipe disconnected from the draw works, the conveyor system 16 may again operate to substantially center the pipe (lengthwise) on the conveyor system.

Still referring to FIG. 11, the next step may be placing the conveyor system 16 in operational relationship to one or more pipe racks (block 1116). Placing the conveyor system 16 in operational relationship may be one or both of horizontally translating the conveyor system 16 away from the drilling rig by operation of the sliding relationship between channel members 60 and the structural support members 52, operation of the lift system 12, or both. Thereafter, the conveyor system 16 and pipe pickup arms 14 are rotated about the longitudinal axis 18 such that the pipe rolls off the conveyor and down the pipe pickup arms 14 onto the pipe rack (block 1120), and the method ends (block 1124). Because the arms of the pipe pickup system 14 extend opposite directions from the conveyor system 16, pipe lay down may take place to pipe racks on opposite sides of the pipe handling system 100.

In at least some embodiments, the pipe handling system 100 has an integrated motor driven hydraulic pump and corresponding fluid reservoir and controls. Thus, the pipe handling system 100 utilizes hydraulically operated actuators and motors, and is self contained. In alternative embodiments, the pipe handling system has an integrated motor driven electrical generator, and thus uses electric motors and actuators. In further alternative embodiments, the power source (whether for hydraulic power or electrical power) may be external to the pipe handling system 100. Although the particular dimensions should not be construed as a limitation on the invention, in some embodiments the length of the conveyor system 16 is approximately 47 feet so as to accommodate a standard 45 foot casing section. The approximately 47 foot conveyor system 16 thus also handles drill pipe, which has a standard 30 foot length. In some embodiments the pipe handling system 100 is operable with drilling rigs whose floors have an approximately 12 to 15 foot elevation. Being operable with floors of drilling rigs in the 12 to 15 foot range is based in some embodiments on having the pipe handling system 100 either on a trailer or on a catwalk, about 40 inches high. However, the pipe handling system 100 can be configured to reach substantially any height floor of a drilling rig from any ground-level orientation (on a catwalk, on a trailer, or sitting directly on the ground).

With regard to operation of the pipe handling system 100, in some embodiments an operator may actuate levers integral with the pipe handling system 100 to individually control the various motions. In alternative embodiments, the various motions of the pipe handling system 100 may be individually wirelessly controlled. In yet still further embodiments, the certain operations may be automated, such as pickup of the pipe and placement of the conveyor system 16 in operational relationship to the floor of the drilling rig.

The above discussion is meant to be illustrative of the principles and various embodiments of the present invention. Numerous variations and modifications will become apparent to those skilled in the art once the above disclosure is fully appreciated. For example, the pipe handling system has been described in relation to the floor of drilling rig; however, the pipe handling system 100 may be used in other situations, such as pipe handling associated with hydrocarbon well "workover" operations. Moreover, while the various embodiments discussed show the conveyor system 16 staying substantially parallel to the ground (from a side perspective) at almost all times, in alternative embodiments an end of the conveyor system 16 closest to the drilling rig may raise while the other ends remains low, thus the conveyor slopes upward toward the floor of the drilling rig. Thus, because of these alternative embodiments the terms "horizontal translation" in the specification should not be read to preclude elevation change simultaneous with the horizontal translation. Moreover, in pickup and lay down operations the conveyor system 16 may remain stationary, with only the pipe pickup system 14 rotating to effectuate the operations to the pipe racks. It is intended that the following claims be interpreted to embrace all such variations and modifications.

What is claimed is:

1. A drill pipe handling system comprising:

a conveyor system; and a pipe pickup system in operational relationship to the conveyor system, the pipe pickup system loads pipe onto the conveyor system selectively from a first side of the conveyor system or a second side of the conveyor system, the first side opposite the second side;

wherein the pipe pickup system further comprises a first set of pickup arms on the first side of the conveyor system that lift pipe from a first pipe rack and allow the pipe to roll onto the conveyor system by force of gravity; and a second set of pickup arms on the second side of the conveyor system that lift pipe from a second pipe rack and allow the pipe to roll onto the conveyor system by force of gravity; and wherein the conveyor system rotates about a longitudinal axis when either the first or second set of pickup arts lift pipe from pipe rack.

2. The drill pipe handling system as defined in claim 1 wherein the conveyor system further comprises a conveyor belt.

3. A method of handling pipe comprising:

placing a pipe on a conveyor when the conveyor is below a floor of a drilling rig, the pipe originating selectively from a first side of the conveyor or a second side of the conveyor, the second side opposite the first side;

wherein the placing further comprises selectively raising the pipe from a first pipe rack on the first side with a first lifting arm, and allowing the pipe to roll to the conveyor by force of gravity, or raising the pipe from a second pipe rack on the second side with a second lifting arm, and allowing the pipe to roll to the conveyor by force of gravity; and raising the conveyor to be in operational relationship to the floor of the drilling rig, wherein raising the conveyor further comprises raising the conveyor along with the first and second lifting arms.

4. The method as defined in claim 3 further comprising horizontally translating the conveyor toward the drill rig.

5. The method as defined in claim 3 further comprising horizontally translating the pipe toward the floor by operation of the conveyor.

6. The method as defined in claim 5 wherein horizontally translating the pipe further comprises horizontally translating as the pipe is raised by draw works of the drilling rig.

7. A drill pipe handling system comprising:

a conveyor system a pipe pickup system in operational relationship to the conveyor system, the pipe pickup system loads pipe onto the conveyor system selectively from a first side of the conveyor system or a second side of the conveyor system, the first side opposite the second side; and a lift system in operational relationship to the conveyor system;

said lift system raises the conveyor system from a first position below a floor of a drilling rig and substantially parallel to the ground to a second position in operational relationship to the floor of the drilling rig; and wherein the lift system lifts both the conveyor system and the pipe pickup system from the first position to the second position.

8. The drill pipe handling system as defined in claim 7 wherein the conveyor system horizontally translates toward the drilling rig independent of horizontal motion provided by the lift system.

9. A method of handling pipe comprising:

placing a pipe on a conveyor when the conveyor is in operational relationship to a floor of a drilling rig;

lowering the conveyor to be below the floor of the drilling rig, wherein lowering the conveyor further comprises lowering the conveyor along with along with a first set of arm members and a second set of arm members; and unloading the pipe from the conveyor by rotation of the conveyor about a longitudinal axis, the unloading selectively from a first side of the conveyor or a second side of the conveyor, the second side opposite the first side;

wherein unloading further comprises, selectively allowing the pipe to roll down the first set of arm members to a first pipe rack on the first side by force of gravity, or allowing the pipe to roll down the second set of arm members to a second pipe rack on the second side by force of gravity.

10. The method as defined in claim 9 further comprising horizontally translating the conveyor away from the drilling rig after the placing.

11. The method as defined in claim 9 wherein placing further comprises horizontally translating the pipe away from the floor by operation of the conveyor.

12. The method as defined in claim 11 wherein horizontally translating the pipe further comprises horizontally translating as the pipe is lowered by draw works of the drilling rig.

* * * * *